US007988486B1

(12) United States Patent
Lin

(10) Patent No.: US 7,988,486 B1
(45) Date of Patent: Aug. 2, 2011

(54) JUNCTION BOX AND CONDUCTIVE TERMINALS THEREIN

(75) Inventor: Chih-Hsin Lin, Xianxi Township, Changhua County (TW)

(73) Assignee: K.S. Terminals Inc., Changhua County (TW)

( * ) Notice: Subject to any disclaimer, the term of this patent is extended or adjusted under 35 U.S.C. 154(b) by 0 days.

(21) Appl. No.: 12/796,823

(22) Filed: Jun. 9, 2010

(51) Int. Cl.
*H01R 13/60* (2006.01)

(52) U.S. Cl. ..... 439/527

(58) Field of Classification Search ..... 439/733.1, 439/527, 828, 709, 716, 441, 834, 835, 786
See application file for complete search history.

(56) References Cited

U.S. PATENT DOCUMENTS 4,195,194 A 3/1980 Kuster et al.
4,460,232 A 7/1984 Sotolongo
5,888,880 A * 3/1999 Gardner et al. ..... 438/424
6,074,241 A * 6/2000 Patel et al. ..... 439/441
7,059,890 B2 * 6/2006 Donhauser ..... 439/409
7,252,534 B2 * 8/2007 Reibke ..... 439/404
7,462,076 B2 * 12/2008 Walter et al. ..... 439/709
7,494,098 B1 * 2/2009 Fulda ..... 248/206.5
7,507,107 B2 * 3/2009 Tuerschmann et al. ..... 439/441
7,927,132 B1 * 4/2011 Lin ..... 439/527
* cited by examiner

*Primary Examiner* — Alexander Gilman
(74) *Attorney, Agent, or Firm* — Ming Chow; Sinorica, LLC

(57) ABSTRACT

Disclosed are a conductive terminal and a junction box having the conductive terminals. The conductive terminal comprises a conducting wire cover, a terminal main body, a first clamping member and a second clamping member. The terminal main body serially comprises a conducting wire base, a sheet body, a first gripping portion and a second gripping portion. The conducting wire cover comprises a first base, a top, a first bend, a first tongue piece and a second bend. The conducting wire base comprises a pair of lodging parts, a second opening, a third opening and a third protrusion projected from the third opening. The first clamping member comprises a pair of third wings, which clamps the first gripping portion. The second clamping member comprises a second tongue piece and a third tongue piece. The pair of the forth protrusions of the second tongue piece engages with the second gripping portion.

16 Claims, 3 Drawing Sheets

JUNCTION BOX AND CONDUCTIVE TERMINALS THEREIN

BACKGROUND OF THE INVENTION

1. Technical Field

The present invention relates to a peripheral device for use with solar cells, and more particularly, to a solar cell junction box that includes conductive terminals to control the power output of the solar cell.

2. Description of Related Art

In recent years, non-renewable energy sources have been in short supply throughout the world, with many industries regarding solar cells as a priority. Current trends in energy savings are looking to the integration of solar cell with building materials and glass, such as the replacement of rooftop materials with solar cells, attaching solar cells to the external walls of buildings and to cover windows, skylights and. Unfortunately, a single solar cell can generate only a small electric current, so multiple cells are often connected via a junction box in parallel or series, to boost the current. Thin film solar cells of prior arts were difficult to use, due to the complex design of junction boxes with conductive terminals, solar cell input/output cables, numerous flat diode chips, and solar cell electrodes. As a result, from the wide range of solar cells available on the market, only thin film solar cells can fit into the junction boxes.

Solar cells and the junction boxes are constantly exposed to severe outdoor conditions, and factors such as temperature change can lead to diodes and conducting wires loosening in junction boxes, affecting the stability of the power output of the solar cells. In prior arts, solar cell installation was inefficient and inconvenient, as technicians had to solder all external connections between electrodes and conductive terminals with welding torches. This has created a need for a new junction box design to take advantage of other solar cell systems.

SUMMARY OF THE INVENTION

To overcome the shortcomings of the prior arts mentioned above, the present invention provides a conductive terminal. The conductive terminal comprises a conducting wire cover, a terminal main body, a first clamping member and a second clamping member. Additionally, the terminal main body made of metal in one piece construction serially comprises a conducting wire base, a sheet body, a first gripping portion and a second gripping portion.

Accordingly, the primary object of the present invention is to provide a conductive terminal. By means of the respective engagement of the conducting wire cover with the conducting wire base, the first clamping member with the first gripping portion, and the second clamping member with the second gripping portion, the assembly of the conductive terminal eliminates the needs of soldering approach.

Another object of the present invention is to provide a conductive terminal. By means of the engagement of the conducting wire cover with the conducting wire base, the conducting wire can be tightly clamped within the first opening of the conducting wire cover. Furthermore, the movement of the conducting wire between the conducting wire cover and the conducting wire base can be limited both vertically and horizontally. Accordingly, there is no need to solder conducting wire of the junction box for solar cell on the conductive terminal.

Yet another object of the present invention is to provide a conductive terminal. By means of the engagement of the first clamping member with the first gripping portion, the first grooves of the first gripping portion can firmly clamp the diode. In this way, there is no need to solder the connection between the conductive terminal and the diode.

Still another object of the present invention is to provide a conductive terminal. By means of the second grooves that are of flat form or of undulating form, ensuring the firm engagement of the forth protrusions of the second clamping member with the second grooves of the second gripping portion. Accordingly, when the ribbon electrode of the solar cell is inserted into the second gripping portion, the ribbon electrode can be clamped tightly at the space formed between the second clamping member and the second gripping portion. In this manner, there is no need to solder the ribbon electrode of the solar cell on the conductive terminal.

Additionally, the present invention provides a junction box. The junction box comprises an insulated housing and a plurality of conductive terminals disposed arrayedly in the insulated housing.

Accordingly, another object of the present invention is to provide a junction box having a plurality of conductive terminals, wherein the conductive terminal disposed therein, by means of the respective engagement of the conducting wire cover with the conducting wire base, the first clamping member with the first gripping portion, and the second clamping member with the second gripping portion, the assembly of the conductive terminal eliminates the needs of soldering approach.

Yet another object of the present invention is to provide a junction box having a plurality of conductive terminals, wherein the conductive terminal disposed therein, by means of the engagement of the conducting wire cover with the conducting wire base, the conducting wire can be tightly clamped within the first opening of the conducting wire cover. Furthermore, the movement of the conducting wire between the conducting wire cover and the conducting wire base can be limited both vertically and horizontally. Accordingly, there is no need to solder conducting wire of the junction box for solar cell on the conductive terminal.

Still another object of the present invention is to provide a junction box having a plurality of conductive terminals, wherein the conductive terminal disposed therein, by means of the engagement of the first clamping member with the first gripping portion, the first grooves of the first gripping portion can firmly clamp the diode. In this way, there is no need to solder the connection between the conductive terminal and the diode.

Still another object of the present invention is to provide a junction box having a plurality of conductive terminals, wherein the conductive terminal disposed therein, by means of the second grooves that are of flat form or of undulating form, ensuring the firm engagement of the forth protrusions of the second clamping member with the second grooves of the second gripping portion. Accordingly, when the ribbon electrode of the solar cell is inserted into the second gripping portion, the ribbon electrode can be clamped tightly at the space formed between the second clamping member and the second gripping portion. In this manner, there is no need to solder the ribbon electrode of the solar cell on the conductive terminal.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein.

DETAILED DESCRIPTION OF THE PREFERRED EMBODIMENT

Some particular embodiments of the invention will be described in detail for purpose of illustration, and one of ordinary skill in the art can easily understand the advantages and efficacy of the present invention through the disclosure of the specification. It is to be understood that alternative embodiments may be possible for the implement and application of the present invention while numerous variations will be possible to the details disclosed in the specification on the strength of diverse concepts and applications without going outside the scope of the invention as disclosed in the claims.

Figure 1A:
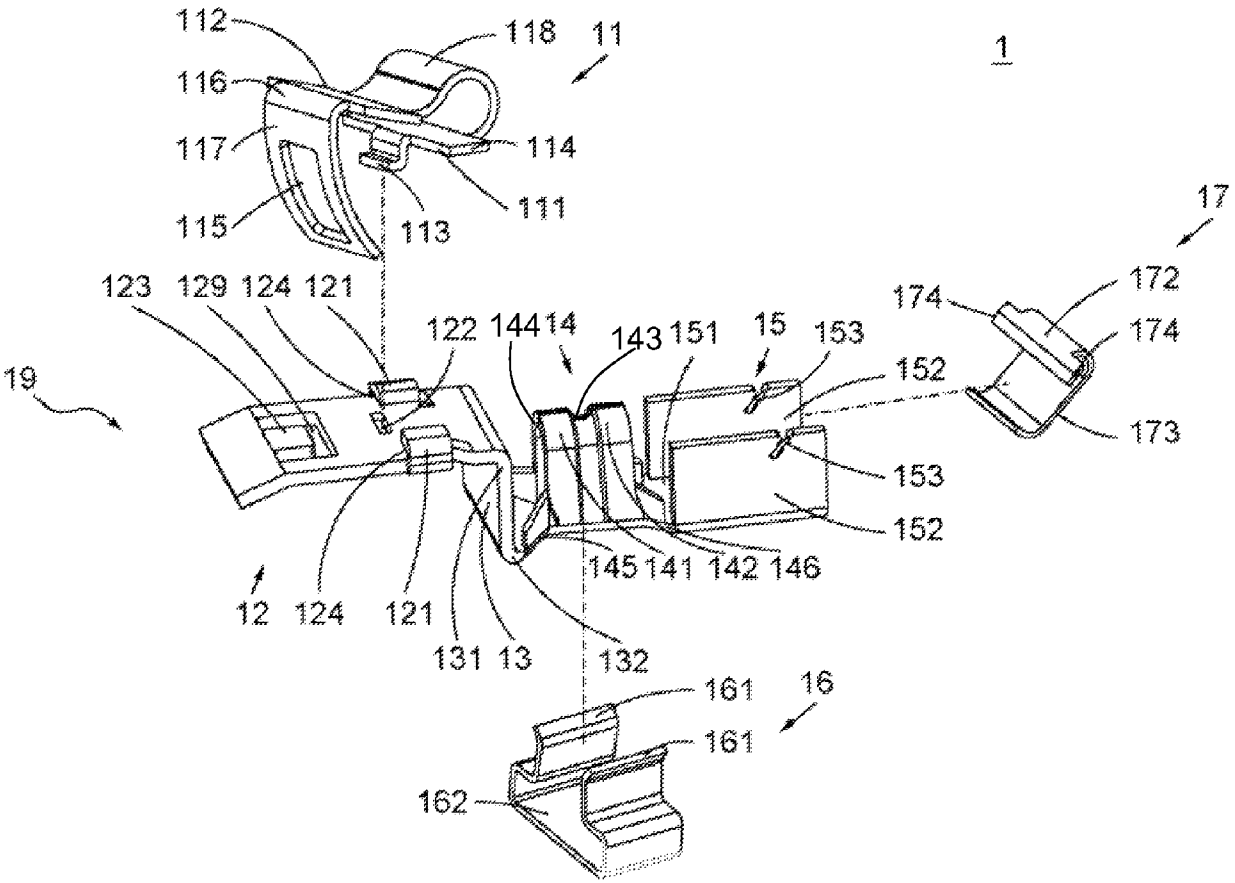
FIG. 1A is a schematic view of a conductive terminal according to the first preferred embodiment of the present invention, individually showing a conducting wire cover, a terminal main body, a first clamping member and a second clamping member without being assembled together to form the conductive terminal.
Figure 1B:
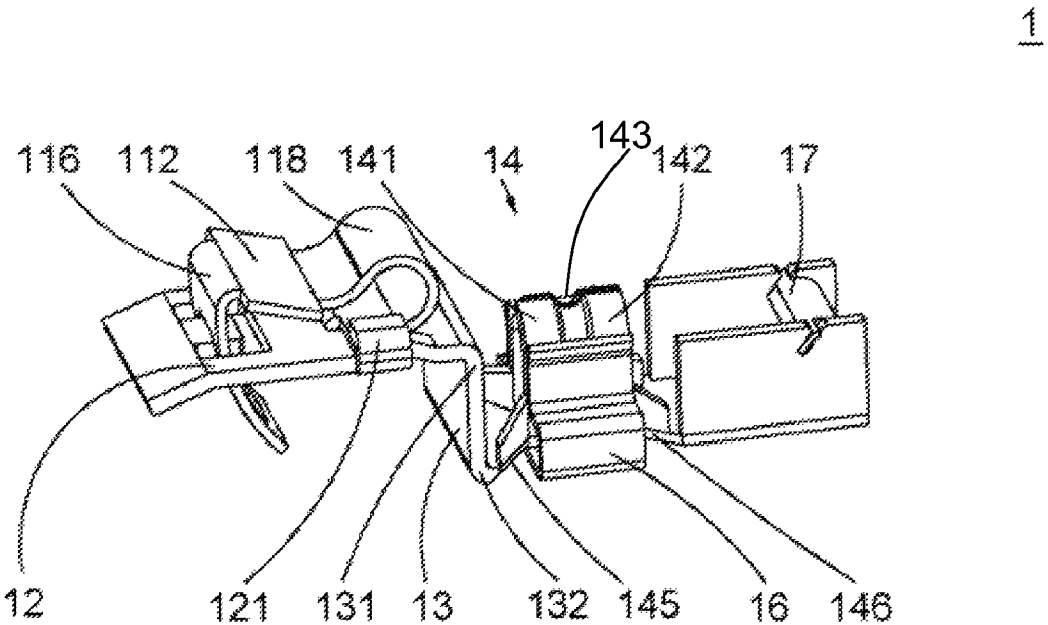
FIG. 1B is a schematic view of a conductive terminal according to the first preferred embodiment of the present invention, showing a conducting wire cover, a terminal main body, a first clamping member and a second clamping member being assembled together to form the conductive terminal.

Please refer to both FIG. 1A and FIG. 1B. The first preferred embodiment of the present invention is a conductive terminal 1. This conductive terminal 1 comprises a conducting wire cover 11, a terminal main body 19, a first clamping member 16 and a second clamping member 17. The terminal main body 19 made of metal in one piece construction serially comprises a conducting wire base 12, a sheet body 13, a first gripping portion 14 and a second gripping portion 15.

The conducting wire cover 11 comprises a first base 111, a top 112, a first bend 116, a first tongue piece 117 and a second bend 118. The first base 111 and the top 112 are interconnected by the second bend 118. A first protrusion 113 is formed at the front edge of the first base 111. Besides, a pair of second protrusions 114 are respectively formed at both lateral sides of the first base 111. In this preferred embodiment, the front edge of the first base 111 is perpendicular to the both lateral sides of the first base 111. The top 112 and the first tongue piece 117 are interconnected by the first bend 116. The first tongue piece 117 has a first opening 115 formed therein.

The conducting wire base 12 comprises a pair of lodging parts 121, a second opening 122, a third opening 129 and a third protrusion 123. The third protrusion 123 is projected from the front end of the third opening 129. In this preferred embodiment, the front end of the third opening 129 is the one that set in front of the rear end, which is near to the pair of lodging parts 121, of the third opening 129. The pair of lodging parts 121 are respectively disposed at both lateral sides of the conducting wire base 12 for engaging with the pair of second protrusions 114 of the conducting wire cover 11. Particularly, a pair of retaining recesses 124 are respectively formed between the upper bent ends of the pair of lodging parts 121 and the conducting wire base 12 for receiving the pair of second protrusions 114 of the conducting wire cover 11. In this preferred embodiment, each upper bent end of each lodging parts 121 is an end that is distal from the conducting wire base 12. Consequently, after the pair of second protrusions 114 of the conducting wire cover 11 engages with the pair of lodging parts 121 of the conducting wire base 12, the pair of retaining recesses 124 can restrain the conducting wire cover 11 from moving upward and downward against the conducting wire base 12 and thereby assist the conducting wire cover 11 in engaging with the conducting wire base 12 more firmly.

The second opening 122 of the conducting wire base 12 is formed in the position corresponding to the first protrusion 113 of the conducting wire cover 11, and thereby the second opening 122 is provided for engaging with the first protrusion 113 of the conducting wire cover 11 when the conducting wire cover 11 is attached to the conducting wire base 12. Moreover, when the conducting wire cover 11 is attached to the conducting wire base 12, the first tongue piece 117 of the conducting wire cover 11 passes through, and thus engages with, the third opening 129 of the conducting wire base 12. Simultaneously, when the conducting wire cover 11 is attached to the conducting wire base 12, the third protrusion 123 within the third opening 129 of the conducting wire base 12 passes through, and thus engages with, the first opening 115 of the conducting wire cover 11. It is noted that the engagement position where the third protrusion 123 within the third opening 129 engages with the first opening 115 in the first tongue piece 117 of the conducting wire cover 11 is the position that clamps the conducting wire (not shown) of the junction box (not shown) for solar cell (not shown). In this manner, the terminal main body 19 conducts electricity with the aforementioned conducting wire (not shown) in this said engagement position.

To be more specific, the following describes the specific method for inlaying aforementioned conducting wire (not shown) of the junction box (not shown) for solar cell (not shown) into the terminal main body 19, by inlaying it through the aforementioned engagement position formed between the conducting wire cover 11 and the conducting wire base 12.

Firstly, when the conducting wire cover 11 is pulled in a direction upwardly away from the conducting wire base 12, a space will be formed at the engagement position between the first opening 115 in the first tongue piece 117 of the conducting wire cover 11 and the third protrusion 123 within the third opening 129 of the conducting wire base 12. This provides a space for the conducting wire (not shown) of the junction box (not shown) for solar cell (not shown) to be passed through for installation.

Next, when the conducting wire cover 11 is released, the first tongue piece 117 of the conducting wire cover 11 snaps back into its original engagement position near the conducting wire base 12, thereby pinching the conducting wire (not shown) between the aforementioned engagement position formed between the conducting wire cover 11 and the conducting wire base 12.

In this manner, the conducting wire (not shown) can be tightly clamped within the first opening 115 of the conducting wire cover 11, thereby eliminating the need to solder the conducting wire (not shown) on the conductive terminal 1 in this preferred embodiment. Moreover, since the conducting wire (not shown) of the junction box (not shown) for solar cell (not shown) passes through the first opening 115 of the conducting wire cover 11, it is easy to check if the conducting wire (not shown) is inlaid and is disposed correctly in the conductive terminal 1. Furthermore, the movement of the conducting wire (not shown) between the conducting wire cover 11 and the conducting wire base 12 can be limited both vertically and horizontally.

More particularly, the connection between the conducting wire cover 11 and the conducting wire base 12 of the terminal main body 19 can be strengthened in three ways.

Firstly, the pair of second protrusions 114 of the conducting wire cover 11 engages with the pair of lodging parts 121 of the conducting wire base 12.

Secondly, the first tongue piece 117 of the conducting wire cover 11 passes through, and thus engages with, the third opening 129 of the conducting wire base 12. Thirdly, at the same time, the first protrusion 113 of the conducting wire cover 11 engages with the second opening 122 of the conducting wire base 12.

The sheet body 13 has a third bend 131 connected to the conducting wire base 12 and a fourth bend 132 connected to the first gripping portion 14. Specifically, the aforementioned fourth bend 132 of the sheet body 13 is connected to the first gripping portion 14 via a first flared part 145 disposed near to the sheet body 13.

A pair of first wings 141 and a pair of second wings 142 are respectively disposed at both lateral sides of the first gripping portion 14. Each of the first wings 141 is positioned alongside the sheet body 13 while each of the second wings 142 is positioned alongside the second gripping portion 15. A first groove 143 is formed between the pair of first wings 141 and the pair of second wings 142. Additionally, the first gripping portion 14 further comprises a first flared part 145 and a second flared part 146. The first flared part 145 is disposed near to the sheet body 13 and connects to the sheet body 13 while the second flared part 146 is disposed near to the second gripping portion 15 and connects to the second gripping portion 15. Specifically, the aforementioned first flared part 145 is connects to the sheet body 13 via the fourth bend 132 of the sheet body 13. Both distal ends of the first wings 141 of the first gripping portion 14 and both distal ends of the second wings 142 are bent to form a R-shaped structure 144. In this preferred embodiment, the aforementioned distal ends of the first wings 141 and the second wings 142 are the ends that are distal from the bottom of the first gripping portion 14. Specifically, the disposition of the first groove 143 between the pair of first wings 141 and the pair of second wings 142 is designed to clamp the diode (not shown) tightly. In this way, there is no need to solder the connection between the conductive terminal 1 and the diode (not shown). Furthermore, the design of the R-shaped structure 144 is intended to strengthen the construction of the first groove 143, hence enable the first groove 143 to firmly clamp the diode (not shown). The first clamping member 16 comprises a third base 162 and a pair of third wings 161 respectively formed at both lateral sides of the third base 162. Specifically, the pair of third wings 161 of the first clamping member 16 are provided to clamp the first gripping portion 14.

The second gripping portion 15 comprises a second base 151 and a pair of side walls 152 respectively disposed at both lateral sides of the second base 151. Each of side walls 152 has a second groove 153 formed therein. The second clamping member 17 comprises a second tongue piece 172 and a third tongue piece 173. Additionally, a pair of forth protrusions 174 are respectively formed at both lateral sides of the second tongue piece 172. Each of the forth protrusions 174 respectively engages with each said second groove 153 of each of the side walls 152 when the second clamping member 17 clamps the second gripping portion 15. Moreover, the third tongue piece 173 is provided for leaning on the second base 151 of the second gripping portion 15 when the second clamping member 17 clamps the second gripping portion 15. Each of the second grooves 153 is located at the top edge of each of the side walls 152. The second groove 153 is formed by extending, in a slant direction, from the top edge of each of the side walls 152 toward the second base 151. In this preferred embodiment, the top edge of the side walls 152 is an edge that is distal from the second base 151. Specifically, the inner surface of the second groove 153 can be of flat form or undulating form. As each of the second grooves 153 is used to firmly engage with each of the forth protrusions 174, the inner surface of the second groove 153 is preferably of undulating form in this preferred embodiment. In this manner, the second clamping member 17 is able to clamps the second gripping portion 15 of the terminal main body 19 more firmly.

Accordingly, when the ribbon electrode (not shown) of the solar cell (not shown) is inserted into the second gripping portion 15, the ribbon electrode (not shown) can be clamped tightly at the space formed between the third tongue piece 173 of the second clamping member 17 and the second gripping portion 15. In this manner, there is no need to solder the ribbon electrode (not shown) of the solar cell (not shown) on the conductive terminal 1 in this preferred embodiment.

Figure 2:
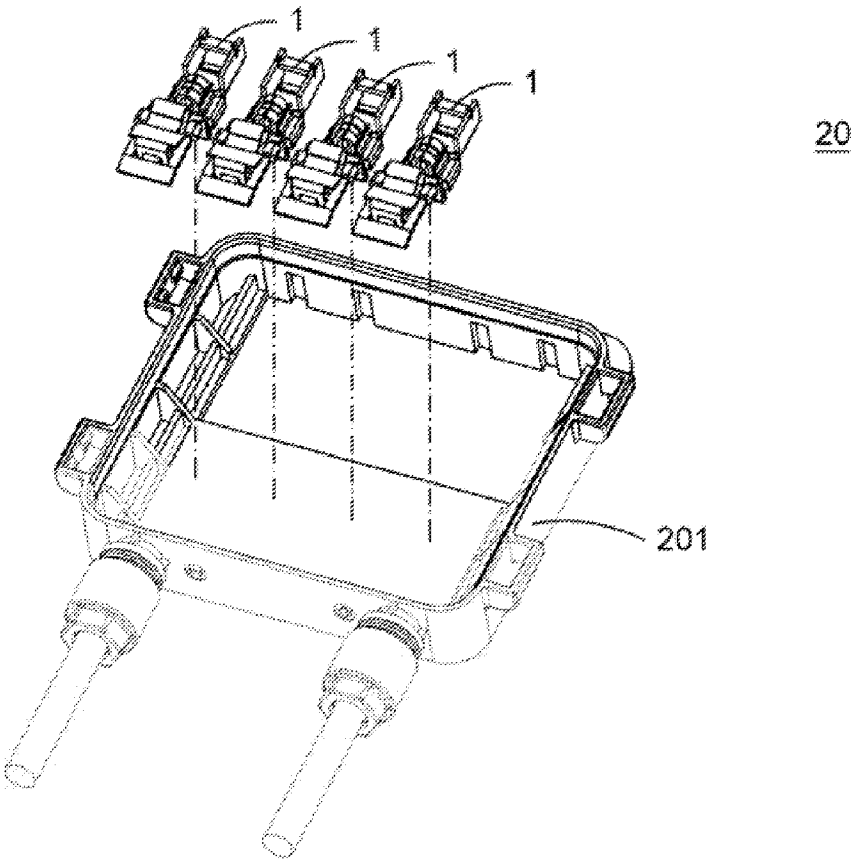
FIG. 2 is a schematic view of a junction box having a plurality of conductive terminals disposed therein according to the second preferred embodiment of the present invention.

Please refer to FIG. 2. The second preferred embodiment of the present invention is a junction box 20. This junction box 20 comprises an insulated housing 201 and a plurality of conductive terminals 1 disposed arrayedly in the insulated housing 201. It is noted that the characteristics and the features of the conductive terminals 1 are substantially the same as those mentioned in the first preferred embodiment.

Although some particular embodiments of the invention have been described in detail for purposes of illustration, it will be understood by one of ordinary skill in the art that numerous variations will be possible to the disclosed embodiments without going outside the scope of the invention as disclosed in the claims.

What is claimed is:

1. A conductive terminal, comprising a conducting wire cover, a terminal main body, a first clamping member and a second clamping member, the conductive terminal being characterized in that:

the terminal main body made of metal in one piece construction serially comprises a conducting wire base, a sheet body, a first gripping portion and a second gripping portion;

the conducting wire cover comprises a first base, a top, a first bend, a first tongue piece and a second bend, wherein:

a first protrusion is formed at a front edge of the first base;

a pair of second protrusions are respectively formed at both lateral sides of the first base;

the top and the first tongue piece are interconnected by the first bend;

the first base and the top are interconnected by the second bend; and the first tongue piece has a first opening formed therein;

the conducting wire base comprises a pair of lodging parts, a second opening, a third opening and a third protrusion projected from a front end of the third opening, wherein:

the pair of lodging parts are respectively disposed at both lateral sides of the conducting wire base for engaging with the pair of second protrusions of the conducting wire cover;

the second opening is provided for engaging with the first protrusion of the conducting wire cover;

the third opening is provided for passing through and for engaging with the first tongue piece of the conducting wire cover; and the third protrusion is provided for passing through and for engaging with the first opening of the conducting wire cover;

a pair of first wings and a pair of second wings are respectively disposed at both lateral sides of the first gripping portion, wherein a first groove is formed between the pair of first wings and the pair of second wings;

the second gripping portion comprises a second base and a pair of side walls respectively disposed at both lateral sides of the second base, wherein each one of the pair of side walls has a second groove formed therein;

the first clamping member comprises a third base and a pair of third wings respectively formed at both lateral sides of the third base, wherein the pair of third wings of the first clamping member are provided for clamping the first gripping portion; and the second clamping member comprises a second tongue piece and a third tongue piece, wherein:

a pair of forth protrusions are respectively formed at both lateral sides of the second tongue piece;

each one of the pair of forth protrusions respectively engages with each said second groove of each one of the pair of side walls; and the third tongue piece is provided for leaning on the second base of the second gripping portion.

2. The conductive terminal according to claim 1, wherein a pair of retaining recesses are respectively formed between the upper bent ends of the pair of lodging parts and the conducting wire base, thereby the pair of retaining recesses is used for receiving the pair of second protrusions of the conducting wire cover.

3. The conductive terminal according to claim 1, wherein:

the sheet body further comprises a third bend and a fourth bend;

the third bend connects to the conducting wire base; and the fourth bend connects to the first gripping portion.

4. The conductive terminal according to claim 1, wherein:

the first gripping portion further comprises a first flared part and a second flared part;

the first flared part connects to the sheet body via the fourth bend; and the second flared part connects to the second gripping portion.

5. The conductive terminal according to claim 1, wherein:

each one of the pair of first wings has a R-shaped structure at its distal end; and each one of the pair of second wings has a R-shaped structure at its distal end.

6. The conductive terminal according to claim 1, wherein:

the second groove is formed by extending, in a slant direction, from the top edge of each one of the pair of the side walls toward the second base; and the inner surface of the second groove is of flat form.

7. The conductive terminal according to claim 1, wherein:

the second groove is formed by extending, in a slant direction, from the top edge of each one of the pair of the side walls toward the second base; and the inner surface of the second groove is of undulating form.

8. The conductive terminal according to claim 1, wherein the pair of third wings of the first clamping member are provided for clamping the pair of first wing and the pair of second wing of the first gripping portion.

9. A junction box, comprising an insulated housing and a plurality of conductive terminals disposed arrayedly in the insulated housing, the conductive terminal serially comprising a conducting wire cover, a terminal main body, a first clamping member and a second clamping member, the conductive terminal being characterized in that:

the terminal main body made of metal in one piece construction comprises a conducting wire base, a sheet body, a first gripping portion and a second gripping portion;

the conducting wire cover comprises a first base, a top, a first bend, a first tongue piece and a second bend, wherein:

a first protrusion is formed at a front edge of the first base;

a pair of second protrusions are respectively formed at both lateral sides of the first base;

the top and the first tongue piece are interconnected by the first bend;

the first base and the top are interconnected by the second bend; and the first tongue piece has a first opening formed therein;

the conducting wire base comprises a pair of lodging parts, a second opening, a third opening and a third protrusion projected from a front end of the third opening, wherein:

the pair of lodging parts are respectively disposed at both lateral sides of the conducting wire base for engaging with the pair of second protrusions of the conducting wire cover;

the second opening is provided for engaging with the first protrusion of the conducting wire cover;

the third opening is provided for passing through and for engaging with the first tongue piece of the conducting wire cover; and the third protrusion is provided for passing through and for engaging with the first opening of the conducting wire cover;

a pair of first wings and a pair of second wings are respectively disposed at both lateral sides of the first gripping portion, wherein a first groove is formed between the pair of first wings and the pair of second wings;

the second gripping portion comprises a second base and a pair of side walls respectively disposed at both lateral sides of the second base, wherein each one of the pair of side walls has a second groove formed therein;

the first clamping member comprises a third base and a pair of third wings respectively formed at both lateral sides of the third base, wherein the pair of third wings of the first clamping member are provided for clamping the first gripping portion; and the second clamping member comprises a second tongue piece and a third tongue piece, wherein:

a pair of forth protrusions are respectively formed at both lateral sides of the second tongue piece;

each one of the pair of forth protrusions respectively engages with each said second groove of each one of the pair of side walls; and the third tongue piece is provided for leaning on the second base of the second gripping portion.

10. The junction box according to claim 9, wherein a pair of retaining recesses are respectively formed between the upper bent ends of the pair of lodging parts and the conducting wire base, thereby the pair of retaining recesses is used for receiving the pair of second protrusions of the conducting wire cover.

11. The junction box according to claim 9, wherein:

the sheet body further comprises a third bend and a fourth bend;

the third bend connects to the conducting wire base; and the fourth bend connects to the first gripping portion.

12. The junction box according to claim 9, wherein:

the first gripping portion further comprises a first flared part and a second flared part;

the first flared part connects to the sheet body via the fourth bend; and the second flared part connects to the second gripping portion.

13. The junction box according to claim 9, wherein:

each one of the pair of first wings has a R-shaped structure at its distal end; and each one of the pair of second wings has a R-shaped structure at its distal end.

14. The junction box according to claim 9, wherein:

the second groove is formed by extending, in a slant direction, from the top edge of each one of the pair of the side walls toward the second base; and the inner surface of the second groove is of flat form.

15. The junction box according to claim 9, wherein:

the second groove is formed by extending, in a slant direction, from the top edge of each one of the pair of the side walls toward the second base; and the inner surface of the second groove is of undulating form.

16. The junction box according to claim 9, wherein the pair of third wings of the first clamping member are provided for clamping the pair of first wing and the pair of second wing of the first gripping portion.

* * * * *